United States Patent [19]

Adachi

[11] 3,978,754

[45] Sept. 7, 1976

[54] VOLTAGE CONTROLLED TYPE ELECTRONIC MUSICAL INSTRUMENT

[75] Inventor: Takeshi Adachi, Hamamatsu, Japan

[73] Assignee: Nippon Gakki Seizo Kabushiki Kaisha, Japan

[22] Filed: Feb. 25, 1975

[21] Appl. No.: 552,755

[30] Foreign Application Priority Data

Feb. 28, 1974 Japan ..... 49-23925[U]

[52] U.S. Cl. ..... 84/1.21; 84/1.1; 84/1.12; 84/1.24; 84/1.27; 84/DIG. 9

[51] Int. Cl.[2] ..... G10H 1/00; G10H 5/02

[58] Field of Search ..... 84/1.01, 1.11, 1.12, 84/1.13, 1.19, 1.2, 1.21, 1.24, 1.26, DIG. 2, DIG. 8, DIG. 9, DIG. 20; 333/70 R, 70 CR

[56] References Cited

UNITED STATES PATENTS

| | | | |
|---|---|---|---|
| 3,288,904 | 11/1966 | George | 84/1.01 |
| 3,316,341 | 4/1967 | Peterson | 84/1.24 |
| 3,614,288 | 10/1971 | Amano | 84/1.21 |
| 3,821,461 | 6/1974 | Mieda | 84/1.19 |
| 3,828,110 | 8/1974 | Colin | 84/1.01 |
| 3,881,387 | 5/1975 | Kawakami | 84/1.24 |
| 3,886,834 | 5/1975 | Okamoto | 84/1.19 X |
| 3,886,836 | 6/1975 | Hiyoshi | 84/1.26 |
| 3,897,709 | 8/1975 | Hiyoshi et al. | 84/1.19 |
| 3,902,392 | 9/1975 | Nagahama | 84/1.01 |
| 3,902,396 | 9/1975 | Hiyoshi | 84/1.19 |

*Primary Examiner*—Stanley J. Witkowski
*Attorney, Agent, or Firm*—Flynn & Frishauf

[57] ABSTRACT

This invention provides an electronic musical instrument comprising a keyboard circuit for producing a pitch determining voltage signal representing the note of an operated key, a voltage controlled oscillator for producing a tone signal having a tone pitch determined by the pitch determining voltage signal, and a voltage controlled lowpass filter for imparting a desired tone color to the tone signal. The voltage controlled lowpass filter is responsive to the pitch determining voltage signal from the keyboard circuit to control the cutoff frequency of the voltage controlled lowpass filter in such a manner that the harmonic content of a higher tone signal is decreased from that of a lower tone signal.

3 Claims, 6 Drawing Figures

VOLTAGE CONTROLLED TYPE ELECTRONIC MUSICAL INSTRUMENT

BACKGROUND OF THE INVENTION

This invention relates to an electronic musical instrument, and more particularly to a keyboard type electronic musical instrument including a voltage controlled tone signal generator.

With a prior art electronic musical instrument, the tone signals derived upon key operation from tone generators are filtered by a tone coloring filter (lowpass filter) having a preselected frequency characteristic to impart a desired tone color to the tone signal. Namely, the cutoff frequency of the tone coloring filter for determining its passband is predetermined to a specified value. Particularly in the pedal tone pitch range, therefore, the balance in respect of tone color and tone volume between a higher pedal tone and a lower pedal tone is lost due to the loudness characteristics of the human ear to generate unnatural musical sounds. This is because, in case of comparison of a lower tone with a higher tone in the pedal tone pitch range, the human ear has a lower sensitivity to the lower tone.

Also with a recently developed synthesizer type electronic musical instrument having a voltage controlled oscillator and a voltage controlled lowpass filter and designed to control the cutoff frequency of the lowpass filter in accordance with the control voltage waveforms whose voltage levels vary as a function of time, arrangement is not so made that the control voltage waveform applied, in case of a higher pedal tone, to the lowpass filter is different from that in case of a lower pedal tone. As a result, there is produced an undesired difference in respect of tone color and tone volume between the lower pedal tone and the higher pedal tone, as in the case of the abovementioned prior art electronic musical instrument.

SUMMARY OF THE INVENTION

The object of the invention is to provide a voltage controlled type electronic musical instrument which is capable of generating, particularly in case of the pedal tones, musical sounds well-balanced in respect of tone color and tone volume throughout the pitch range.

The electronic musical instrument according to the invention comprises a keyboard section for producing a pitch determining voltage signal indicating the note of an operated key, a voltage controlled oscillator for producing a tone signal having a pitch frequency determined by the pitch determining voltage signal, and a tone coloring filter for imparting a desired tone color to the tone signal.

According to the invention, the tone coloring filter is of a voltage controlled type, and is operated in response to the pitch determining voltage signal from the keyboard section, so that the cutoff frequency for a lower note tone becomes higher than that for a higher note tone. As a result, the harmonic content of the lower note tone is increased as compared with that of the higher note tone, thereby to reduce the undesired difference in respect of tone color and tone volume between the higher note tone and the lower note tone. Where, particularly concerning pedal tones having a tone pitch range of two octaves, the cutoff frequency for the lowest note tone (C1) and the cutoff frequency for the highest note tone (C3) are shifted, respectively, by about half the octave in mutually opposite directions with respect to the cutoff frequency for the middle note tone (C2) of the two-octave range, a good result was obtained.

DETAILED DESCRIPTION OF THE INVENTION

Figure 1:
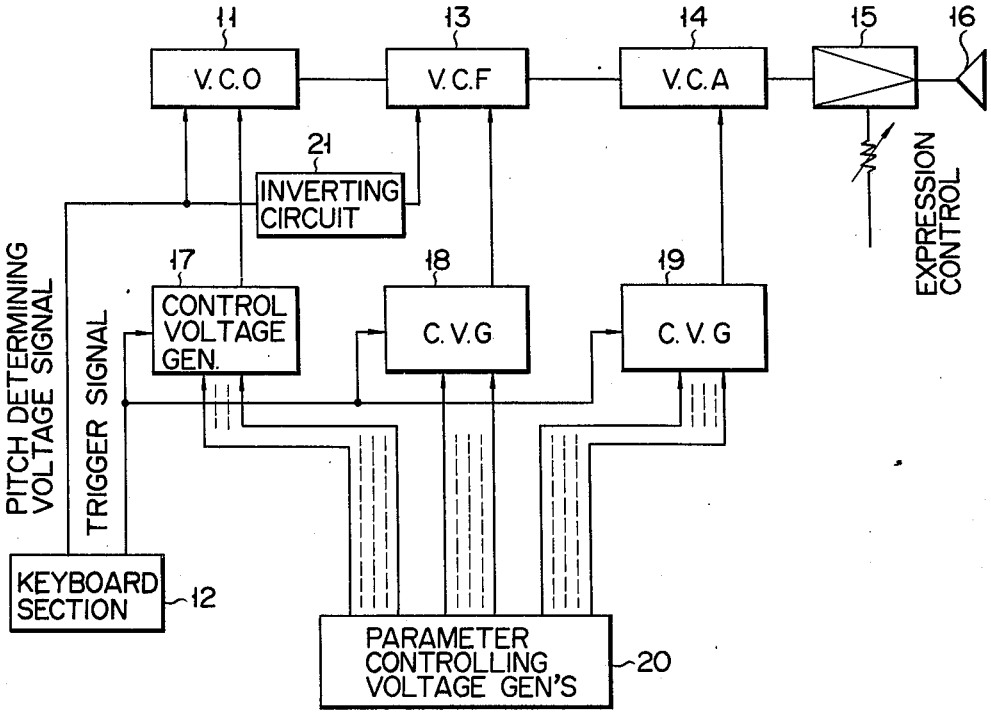
FIG. 1 is a block diagram of an electronic musical instrument according to an embodiment of this invention.

FIG. 1 shows one embodiment of this invention. In the drawing a reference numeral 11 shows a voltage controlled oscillator (hereinafter referred to as VCO). VCO 11 generates, in response to a pitch determining voltage signal obtained by key operation at a pedal keyboard section 12, a tone signal having a pitch (frequency) for the note of an operated key. The tone signal from VCO 11 is coupled to a voltage controlled filter (hereinafter referred to as VCF), where a tone color is imparted to the tone signal, and then to a voltage controlled amplifier 14 (hereinafter referred to as VCA). The outut of VCA 14 is fed through an output amplifier 15 to a loudspeaker 16. Control voltage generators 17 to 19 are provided to control the pitch, tone color and tone volume of the tone signal and coupled to VCO 11, VCF 13 and VCA 14, respectively. Control voltage generators 17 to 19 generate, in response to a trigger signal obtained by the key actuation at the keyboard section 12 which continues from key depression to key release, control voltage signals which are coupled to VCO 11, VCF 13 and VCA 14 respectively. VCO 11 is adapted to transiently vary according to the waveform of the control voltage signal from the control voltage generator 17, the frequency of the tone signal corresponding to the operated key; VCF 13 has this cutoff frequency transiently varied according to the waveform of the control voltage signal from the control voltage generator 18; and VCA 14 has its amplification gain controlled according to the waveform of the control voltage signal from the control voltage generator 19 to impart a desired envelope to the filtered tone signal from the VCF 13.

Figure 3:
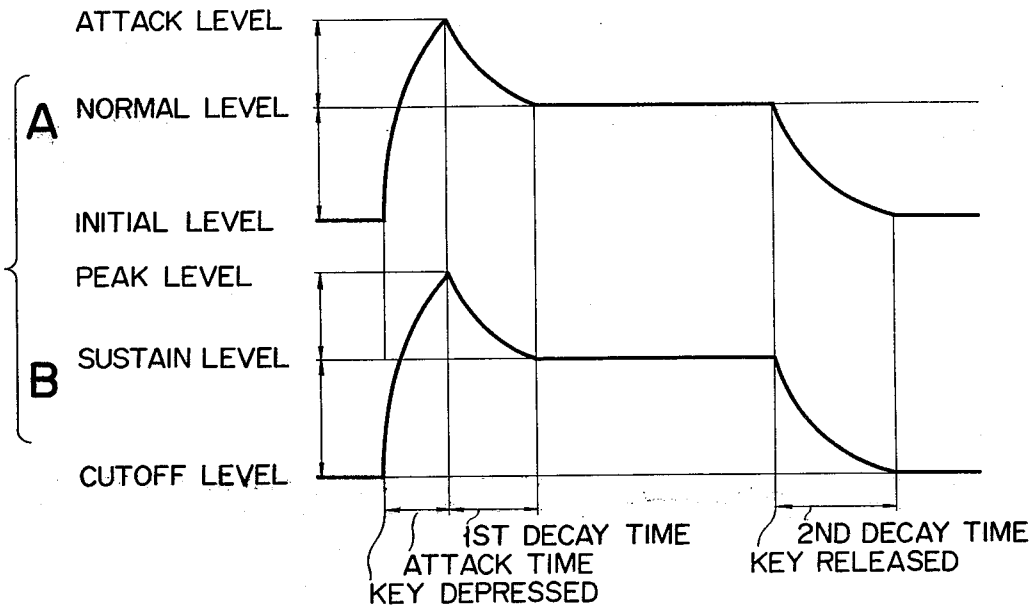
FIG. 3 shows waveform A of a control voltage signal supplied to the voltage controlled oscillator and voltage controlled filter of FIG. 1, and waveform B of control voltage signal supplied to the voltage controlled amplifier of FIG. 1.

FIG. 3 shows the graphical representation of control voltage waveforms obtained from the control voltage generators 17 to 19. In FIG. 3, waveform A shows the positive going control voltage applied to VCO 11 and waveform VCF 13 and B shows the positive going control voltage applied to VCA 14. When the key is depressed the voltage waveform A rises, during an attach time or rise time, from an initial level to an attack level and then decays, during a first decay time, from the attack level to a normal level. The normal level is continued until the key is released. After release of the key, the voltage waveform further decays, during a second decay time, from the normal level to the initial level.

When the voltage waveform A is fed to VCO 11, a tone signal is so controlled that its frequency abruptly varies during the key depression time from the initial level frequency which is somewhat lower than the normal level frequency to the attack level frequency which is somewhat higher than the normal level frequency. Thereafter, the tone signal frequency approaches, during the first decay time, to the normal level frequency which is the correct frequency for the pitch determining voltage from the keyboard section 12. After lapse of the first decay time, the tone signal frequency becomes equal to the normal level frequency. After release of the key, the tone signal frequency decays, during the second decay time, from the normal level frequency to the initial level frequency. That is, the tone signal frequency obtained from VCO 11 is modified according to the voltage waveform which varies as a function of time.

When the voltage waveform A is supplied to VCF 13, the cutoff frequency of the voltage controlled filter is controlled in accordance with the waveform and, consequently, the tone color of the tone signal is transiently modified. In this case, the cutoff frequency of VCF 13 becomes higher as the control voltage waveform goes more positive.

A voltage waveform B rises, upon depression of the key, from a cutoff level to a peak level. After lapse of the attack time, the voltage waveform is returned, during the first decay time, to a sustain level, and the sustain level is continued until the key is released. After release of the key, the voltage waveform decays, during the second decay time, from the sustain level to the cutoff level. When the voltage waveform B is supplied to VCA 14, such an envelope as is shown in the waveform B is imparted to the tone signal. When no voltage waveform B is applied to VCA 14, VCA 14 is in the cutoff state. It will be understood that VCA 14 is operated as a tone keyer.

With the electronic musical instrument of this invention, the above mentioned VCO 11, VCF 13 and VCA 14 and control voltage generators 17 to 19 may be of the known configurations. The control voltage generators 17 to 19 may be so designed as to cause various parameters of the waveform to be controlled by parameter controlling voltages. To this end, parameter controlling voltage generators 20 are additionally provided. In this case, the generators 20 may be provided with a power source and parameter controlling potentiometers connected across the power source. The sliders of the potentiometers should preferably be placed on the control panel of an electronic musical instrument so as to enable a player freely to control various parameters of the waveform of the control voltages. The magnitude of each parameter controlling voltage is adjusted by the potentiometer slider. Such an example was invented by Hiyoshi et al and disclosed in U.S. Pat. application Ser. No. 457,646 filed on Apr. 3, 1974, and now U.S. Pat. No. 3,897,709. U.S. Patent application under Ser. No. 472,827 filed on May 23, 1975, and now U.S. Pat. No. 3,902,392 by Nagahama also discloses similar construction for such portion. U.S. application Ser. Nos. 457,646 and 472,827 are both assigned to the same assignee as the present application.

Figure 2:
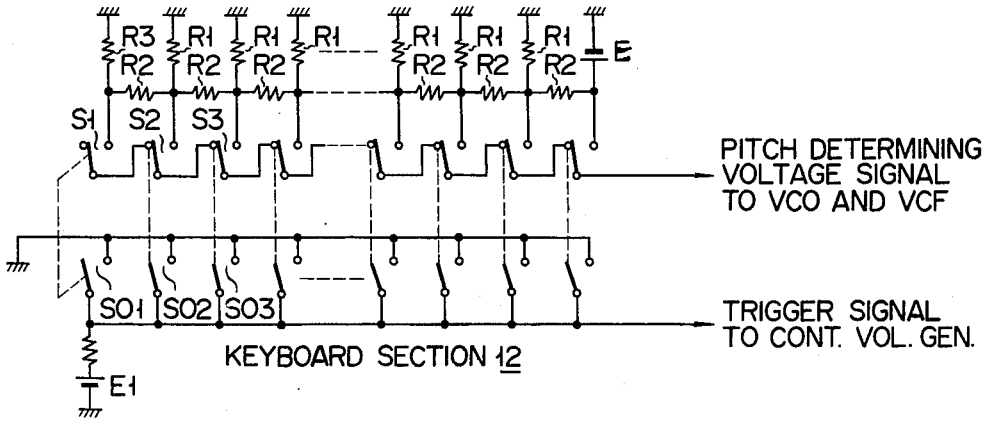
FIG. 2 is a circuit arrangement of the keyboard section of FIG. 1.

FIG. 2 shows the arrangement of the keyboard section 12 from which a pitch determining voltage signal is supplied to VCO 11. The voltage of a power source E (e.g. 2 volts) is divided by a voltage dividing circuit arrangement including resistors R1, R2 and R3 where $R2 = (2^{1/12} + 2^{1/12} - 2)R1$ and $R3 = (2^{1/12} - 1)R1$, and the normally open fixed contacts of key switches S1, S2, S3, . . . . are connected to the respective voltage dividing points. The movable contacts of the respective key switches are connected to the normally closed fixed contacts of the adjacent key switches. When a plurality of keys are depressed at a time, a voltage of the voltage dividing point connected to the key switch actuated by the key corresponding to the highest note of actuated keys and having a value decisive of the note is fed to VCO 11 in the key switch arrangement shown. There are further provided key switches SO1, SO2, SO3 . . . . which are ganged with the key switches S1, S2, S3 . . . . respectively. When the key is operated, a trigger signal which is a negative going voltage of change from a power source voltage E1 volts to zero volts is supplied to the control voltage generators 17 to 19. The control voltage generators 17 to 19 start the formation of control voltages upon receipt of the trigger signal.

Figure 5:
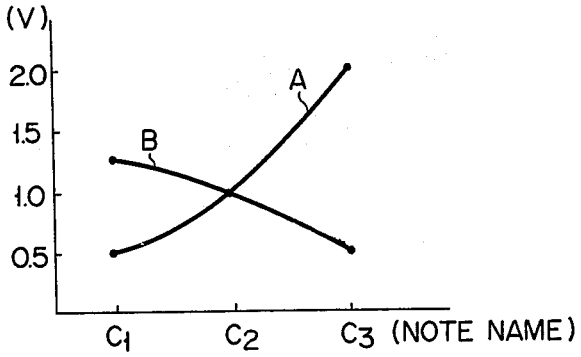
FIG. 5 shows the voltage relationship between output signals (pitch determining voltage signal) from the keyboard section and the inverting circuit of FIG. 1 with respect to note names.

As the frequencies of tones show an exponential function with respect to the note names, the voltage value of the pitch determining voltage signal given forth by the keyboard section 12 should also vary, as illustrated by the curve A of FIG. 5, exponentially with respect to the note names.

According to this invention, the pitch determining voltage signal delivered from the keyboard section 12 is supplied to VCF 13 through an inverting circuit 21 which can produce output voltages the magnitude variation of which with respect to the note names is opposite to that of the pitch determining voltage signals from the keyboard section 12, as shown by the curve B of FIG. 5. That is, the output voltage of the inverting circuit 21 when a lower note key is depressed becomes greater than that when a higher note key is depressed.

Figure 6:
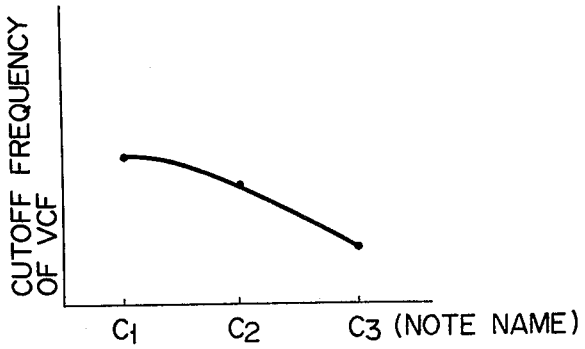
FIG. 6 shows a cutoff frequency characteristic of VCF with respect to the note names.

Accordingly, it will be noted that the cutoff frequency of VCF 13 varies as shown in FIG. 6 in accordance with the output of the inverting circuit 21. That is, the cutoff frequency of VCF 13 when a lower note tone is played becomes higher than that when a higher note tone is played, thus more increasing the harmonic content of the lower note tone than that of the higher note tone.

As apparent from the control wave A of FIG. 3, VCF 13 of FIG. 1 is so designed that the cutoff frequency becomes higher as the voltage value of the control voltage signal increases. For this reason, in the embodiment of FIG. 1, a pitch determining voltage signal is applied to VCF 13 through the inverting circuit 21. However, VCF 13 may be so arranged that the cutoff frequency becomes lower as a value of control voltage decreases. In this case, a pitch determining voltage signal may be applied to VCF 13 without inverting.

Figure 4:
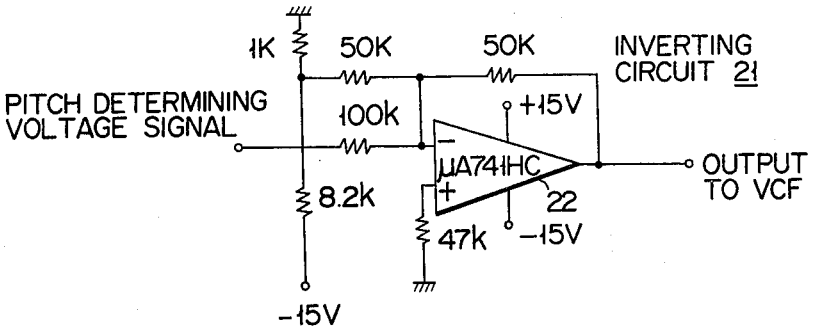
FIG. 4 shows an example of the inverting circuit of FIG. 1.

FIG. 4 is a circuit diagram using an operational amplifier 22 suitable for the inverting circuit 21. The operational amplifier 22 is preferably a $\mu$A741 HC monolithic operational amplifier manufactured by Fairchild Camera and Instrument Systems. The pitch determining voltage signal of the keyboard section 12 is applied to the inverting input terminal of the operational amplifier 22.

Therefore, the pitch determining voltage signal is inverted by the operational amplifier 22. However, the output of operational amplifier 22 is subjected to a level shift of +1.5V, thus providing the output characteristic as shown by the curve B of FIG. 5. By the output of the inverting circuit 21, VCF 13 has the cutoff frequencies for the lowest and highest notes C1 and C2 increased and decreased, respectively, by about half octave with respect to the cutoff frequency for the middle note C2.

What is claimed is:

1. An electronic musical instrument comprising:

a keyboard section including keys and means for generating in response to key operation a pitch determining voltage signal having a voltage representing the note of an operated key and a trigger signal indicative of the actuation of the key;

voltage controlled oscillator means coupled to said keyboard section and responsive to the pitch determining voltage signal to generate a tone signal having a pitch frequency determined by said pitch determining voltage signal;

voltage controlled filter means including a voltage controlled variable cutoff frequency setting means and coupled to said voltage controlled oscillator means and to said keyboard section for imparting a tone color to the tone signal from said keyboard section, said voltage controlled filter means being responsive to the pitch determining voltage signal from said keyboard section to set the cutoff frequency thereof to a low frequency value when said pitch determining voltage signal represents a higher note, and to set the cutoff frequency thereof to a higher frequency value than said low frequency value when said pitch determining voltage signal represents a note lower than said higher note;

control voltage generating means coupled to said keyboard section and responsive to the trigger signal from said keyboard section to generate control voltage waveforms which vary as a function of time and which are coupled to said voltage controlled oscillator means and to said voltage controlled filter means to vary the oscillation frequency of said voltage controlled oscillator means and the frequency characteristics of said voltage controlled filter means, respectively; and sound reproducing means coupled to said voltage controlled filter means for producing musical sounds.

2. An electronic musical instrument according to claim 1 comprising means connected to receive the pitch determining voltage signal from said keyboard section for producing a control voltage signal which is coupled to said voltage controlled filter means to vary the cutoff frequency of said voltage controlled filter means as a function of the amplitude of the control voltage signal, the amplitude variation of the control voltage signals with respect to the notes of keys being opposite to that of the pitch determining voltage signal.

3. An electronic musical instrument according to claim 1 further comprising voltage controlled amplifier means coupled between said voltage controlled filter means and said sound reproducing means; and further control voltage generating means coupled to said keyboard section and to said voltage controlled amplifier means for generating in response to the trigger signal from said keyboard section a control voltage waveform which varies as a function of time and which is coupled to said voltage controlled amplifier means to vary the gain thereof as a function of the control voltage waveform.

* * * * *